US006834602B1

(12) United States Patent
Hall

(10) Patent No.: US 6,834,602 B1
(45) Date of Patent: Dec. 28, 2004

(54) METHOD AND APPARATUS FOR FORMING CUT AND LOOP PILE TUFTS

(75) Inventor: Wilton Hall, Fort Oglethorpe, GA (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 10/760,848

(22) Filed: Jan. 20, 2004

(51) Int. Cl.[7] ..... D05C 15/24
(52) U.S. Cl. ..... 112/80.55; 112/475.23
(58) Field of Search ..... 112/80.55, 80.56, 112/80.58, 80.59, 80.6, 475.01, 475.08, 475.18, 475.23

(56) References Cited

U.S. PATENT DOCUMENTS

| | | | | |
|---|---|---|---|---|
| 2,990,792 A | | 7/1961 | Nowicki et al. | |
| 3,084,645 A | | 4/1963 | Card | |
| 3,203,379 A | | 8/1965 | Dedmon et al. | |
| 3,662,697 A | * | 5/1972 | Passons et al. | 112/80.6 |
| 3,919,953 A | | 11/1975 | Card et al. | |
| 4,048,930 A | | 9/1977 | Card | |
| 4,103,629 A | | 8/1978 | Card | |
| 4,134,347 A | | 1/1979 | Jolley et al. | |
| 4,303,024 A | | 12/1981 | Bardsley | |
| 4,366,761 A | | 1/1983 | Card | |
| 4,440,102 A | | 4/1984 | Card et al. | |
| 4,448,137 A | | 5/1984 | Curtis et al. | |
| 4,619,212 A | | 10/1986 | Card et al. | |
| 4,630,558 A | | 12/1986 | Card et al. | |
| 4,815,403 A | | 3/1989 | Card et al. | |
| 4,817,541 A | * | 4/1989 | Magourik | 112/80.6 |
| 4,836,118 A | | 6/1989 | Card et al. | |
| 4,903,624 A | | 2/1990 | Card et al. | |
| 4,903,625 A | | 2/1990 | Card et al. | |
| 5,058,518 A | | 10/1991 | Card et al. | |
| 5,224,434 A | | 7/1993 | Card et al. | |
| 5,295,450 A | | 3/1994 | Neely | |
| 5,400,727 A | | 3/1995 | Neely | |
| 5,495,815 A | * | 3/1996 | Bagnall | 112/80.5 |
| 5,499,588 A | | 3/1996 | Card et al. | |
| 5,513,586 A | | 5/1996 | Neely et al. | |
| 5,706,744 A | | 1/1998 | Card et al. | |
| 5,896,821 A | | 4/1999 | Neely et al. | |

OTHER PUBLICATIONS

Max M. Beasley, Mechanical Development in Tufting Machinery, Textile Engineering Conference, Apr. 19–20, 1966, pp. 1–5, The American Society of Mechanical Engineers, New York, NY.

* cited by examiner

*Primary Examiner*—Ismael Izaguirre
(74) *Attorney, Agent, or Firm*—Womble Carlyle Sandridge & Rice, PLLC

(57) ABSTRACT

A tufting machine that includes spaced rows of needles of inserting yarns into a backing material. The needles are engaged by opposed loopers and cut pile hooks that pass between one another so as to engage the opposite row of needles for forming cut pile and loop pile tufts of yarn in the backing material.

17 Claims, 4 Drawing Sheets

METHOD AND APPARATUS FOR FORMING CUT AND LOOP PILE TUFTS

FIELD OF THE INVENTION

The present invention generally relates to tufting carpets, and in particular to a method and system for tufting loop pile and cut pile tufts in a backing material to form patterned carpets.

BACKGROUND OF THE INVENTION

In the field of tufting carpets, it has been known to tuft carpets having spaced rows of loop pile and cut pile tufts, including the formation of loop pile and cut pile tufts in the same longitudinal tuft rows of the carpets. For example, U.S. Pat. No. 3,919,953 discloses an apparatus and method for tufting spaced rows of loop pile and cut pile tufts formed in a backing material using a multi-needle tufting machine having two transverse rows of needles with each row cooperating with a series of loop pile loopers or cut pile hooks. Still further, U.S. Pat. Nos. 5,224,434 and 5,499,588 disclose methods and apparatus for producing cut pile and loop pile tufts in the same longitudinal rows of tufting and which further provide for the shifting of the needle bars carrying spaced rows of needles to provide enhanced pattern effects such as the formation of cut and loop pile tufts in the same tuft rows.

For higher or finer gauge tufting machines, i.e., 5/32–1/16 gauge machines, however, as the spacing between the needles is narrowed for forming finer gauge carpets, problems exist whereby the cut pile hooks will tend to engage the previously formed loop pile tufts, potentially resulting in the cutting or pulling of such tufts, creating defects in the carpet. One solution that has developed for this problem has been to move the loopers and hooks so that the loopers and hooks will reach through or between their associated rows of needles to engage and pick up yarns from the opposite row of needles. For example, the cut pile hooks that are positioned below the downstream or rear row of needles are passed between the needles of the rear row of needles and the loop pile loopers to engage the corresponding needles of a first row of needles, while the loop pile loopers are passed between the needles of the first or upstream row of needles and the cut pile hooks to engage needles along the rear or downstream row of needles. However, for higher or finer gauge machines, as the spacing between the loopers is decreased, the problem still can exist whereby the knives for the cut pile hooks can be engaged or can interfere with the passage of the loop pile loops. Attempts to solve this problem by spacing the rows of needles further apart can, however, lead to additional problems with the stretching of the backing material, causing side matching problems due to the stretching and resultant necking in of the backing material as the tufts of yarn are introduced therein.

Accordingly, it can be seen that a need exists for a method and system of forming cut pile and loop pile tufts in a backing material to form patterned carpets that addresses the foregoing related and unrelated problems in the art.

SUMMARY

Briefly, described, the present invention generally relates to a method and apparatus for forming or introducing loop pile and cut pile tufts of yarns into a backing fabric passing through a tufting zone of a tufting machine to form tufted carpets. The tufting machine generally will include first and second rows of transversely spaced needles that receive a series of yarns from a yarn source or yarn feed drive mechanism. The needles generally are spaced along needle bars at a prescribed gauge spacing, i.e., 1/8 inch, 1/16 inch, 5/32 inch, etc., and are reciprocated into and out of engagement with a backing material passing through a tufting zone of the tufting machine for introduction of tufts of yarn into the backing material to form tufted carpets.

A looper assembly is mounted below the backing material and generally includes two spaced, transversely extending rows of loop pile loopers and cut pile hooks mounted along opposite sides of the tufting zone for the tufting machine. Typically, the loop pile loopers will be arranged in spaced series along an upstream side of the tufting zone, facing along the direction of feed of the backing material through the tufting zone, while the cut pile hooks generally will be mounted along the opposite side of the tufting zone from the loopers. Each of the loopers generally includes a shank portion attached to a looper support and a bill or forward portion extending forwardly from the shank portion toward an associated needle. The bill of each looper will engage or strike a take-off portion of its associated needle to engage and pickup a loop of yarn from the needle for forming loop pile tufts in the backing material.

Similarly, the cut pile hooks each include a shank or body portion and a throat portion that extends forwardly from the shank portion and terminates in a hooked or curved forward end. Each hook will engage an associated needle at a pickup or takeoff portion thereof so as to pickup and form loops of yarns along the throat portion of the hook. Each cut pile hook further generally will include a knife assembly associated therewith, which includes a knife or cutting blade that is moved in a reciprocal cutting motion along the throat portion of its associated hook so as to sever or cut the loops of yarn collected along the hook to form cut pile tufts in the backing material.

With the system of the present invention, the cut pile hooks and loop pile loopers generally are staggered transversely from each other with each of the loopers being aligned with a gap between each of the cut pile hooks and each of the cut pile hooks accordingly being aligned with the gaps defined between each of the loopers. As the needles penetrate the backing, the loopers and cut pile hooks will be reciprocated into engagement with their associated needles and will pass between each other such that the loopers will engage the second or rear row of needles, while the cut pile hooks will thus engage the first or forward row of needles of the tufting machine.

Further, the knives of each of the cut-pile hooks are of an opposite hand cutting to the takeoff or pickup cut pile needles of the first row of cut pile needles and will be positioned on the pickup side their associated hooks, so as to be positioned along the same side of their hook as the needle being engaged by the hook. Accordingly, during operation of the tufting machine, the loopers and cut pile hooks will tend to pass between each other and engage the opposite row of needles as the needles penetrate the backing material to form both loop pile and cut pile tufts of yarns in the backing material, as the knives of each of the cut pile hooks are moved about the reciprocating cutting motion to engage and cut the loops collected along the throat portions of their associated cut pile hooks to form the cut pile tufts.

Various objects, features and advantages of the present invention will become apparent to those skilled in the art upon a review of the following detailed description when taken in conjunction with the accompanying drawings.

DETAILED DESCRIPTION OF THE INVENTION

Figure 1:
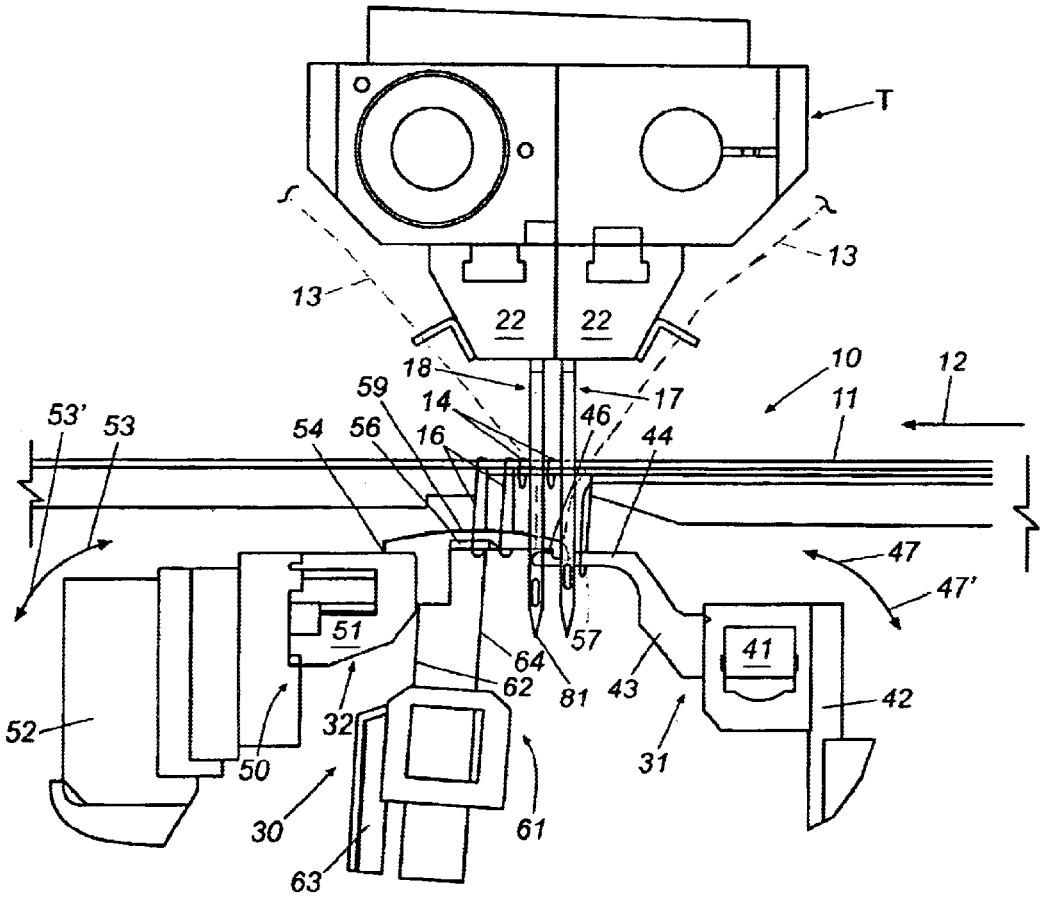
FIG. 1 is a side elevational view illustrating the engagement of the cut pile hooks and loopers with opposed rows of needles according to the present invention.

Referring now in greater detail to the drawings in which like numerals indicate like parts throughout the several views, the present invention generally relates to a method and system for forming tufting carpets having loop pile and cut pile tufts of yarns formed therein for forming various sculpted or other patterned effects in the carpet. As illustrated in FIG. 1, a tufting machine T utilizing the present invention, generally will include a tufting zone 10 through which a backing material 11 is fed in a feed direction, generally indicated by arrow 12 for the introduction of yarns (shown by dashed lines 13) fed from a yarn feed device or source (not shown) into the backing material 11 to form loop pile tufts 14 and cut pile tufts 16, respectively, in the backing material.

The tufting machine generally will include two spaced rows of needles 17 and 18, although only one needle 17, 18 of each row is shown for clarity. The first or forwardmost row of needles 17 comprise cut pile needles for inserting cut pile yarns in the backing 11 while the second or rear row of needles 18 comprise loop pile needles for inserting loop pile yarns into the backing material 11 as shown in FIG. 1. Each needle 17 or 18 includes a pickup or takeoff area or portion 19 along their lower end or point 21 and a channel along which a yarn 13 is received.

The needles generally are mounted to a pair of reciprocating needle bars 22 that are driven by the operation of the main shaft of the tufting machine so as to move the needles about their reciprocating path into the backing material for delivering the yarns 13 thereto. The needle bars 22 further can be dual shiftable needle bars shifted by a shift mechanism (not shown). While two needle bars are shown, it is envisioned that a single needle bar with two rows of transversely spaced needles also could be utilized in the tufting machine of the present invention.

Mounted beneath the tufting zone 10 is a looper assembly 30 as indicated in FIG. 1. The looper assembly 30 generally includes a series of loop pile loopers 31 mounted in spaced series along an upstream or first side of a tufting zone, beneath the cut pile needles 17 and facing in the feed direction 12 of the backing material 11, and a series of transversely spaced cut pile hook assemblies 32 positioned along the downstream side of the tufting zone below the loop pile needles 18. It will be understood by those skilled in the art that while only a few loop pile loopers and cut pile hook assemblies have been illustrated in the drawings for clarity, in practice, a number of loop pile loopers and cut pile hook assemblies will be provided in spaced series extending across the width of the tufting machine, with the number of loopers and cut pile hook assemblies being dependant upon the size of the tufting machine and number of needles thereof.

Figure 2:
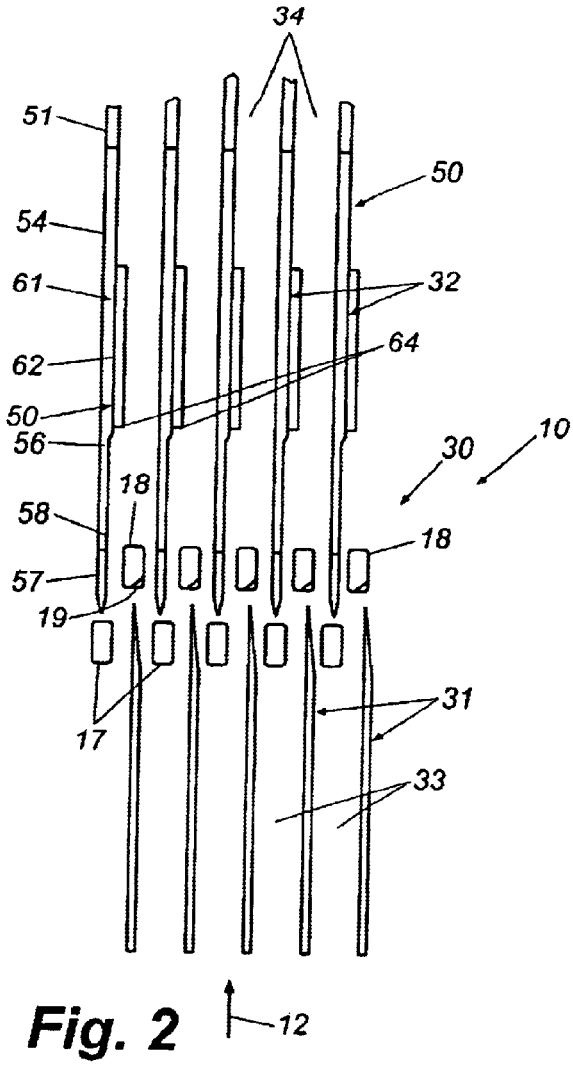
FIG. 2 is a schematic illustration showing the movement of the loopers and cut pile hooks between one another into engagement with the opposed rows of needles according to the present invention.

As shown in FIG. 2, the loopers 31 are spaced transversely apart so as to define gaps 33 therebetween, while the cut pile hook assemblies are transversely spaced and define gaps 34 therebetween. The loop pile loopers are aligned with the gaps 34 between each of the cut pile hook assemblies. Conversely, the cut pile hook assemblies 32 are each aligned with the gaps 33 between the loopers. Similarly, the cut pile needles will be positioned so as to travel through the gaps 33 between the loopers, while the loop pile needles 18 are positioned to reciprocate through the gaps 34 between the cut pile hook assemblies 32. In operation, the loopers and cut pile hook assemblies then will pass between the cut pile and loop pile needles, respectively, in an intermeshing type of movement to engage their respective needles on the opposite side of the tufting zone as indicated in FIGS. 1 and 2.

As illustrated in FIG. 1, each loop pile looper 31 of the looper assembly 30 generally includes a shank portion 41 that is mounted in a holder or block 42; and a forward body portion 43 that terminates in a tapered bill or forward end 44. During operation of the tufting machine, the loop pile loopers are rocked forwardly as indicated by arrow 47 so that the bill portion 44 of each loop pile looper 31 passes into the gap 34 (FIG. 2) between each of the cut pile hook assemblies 32 and engages the takeoff portion 19 of its associated loop pile needle 18, so as to pick up and pull a loop of yarn, indicated by 46 in FIG. 1, away from the loop pile needle 18. As each looper 31 is reciprocated rearwardly in the direction of arrow 47' and the loop pile needles 18 are reciprocated vertically back to their initial, raised position above the backing material, the loopers pick up and pull the yarns 13 away from the needles 18. As a result, a series of loops of yarn 46 will be formed along the bill portion of each looper for forming the loop pile tufts 14 in the backing material.

Figure 3A:
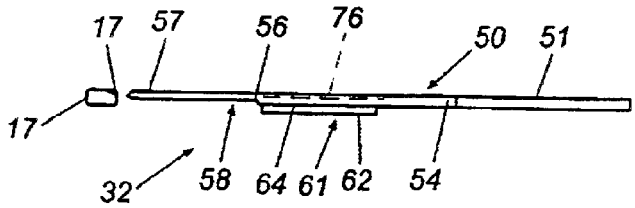
FIG. 3A is a top plan view illustrating the configuration of a cut pile hook according to the present invention.
Figure 3B:
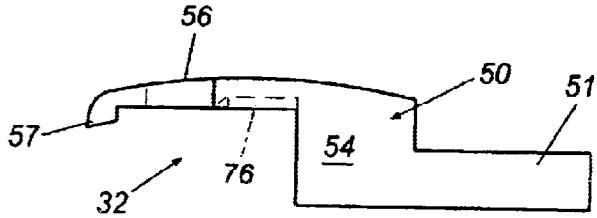
FIG. 3B is a side elevational view of a cut pile hook according to the present invention.

As illustrated in FIGS. 1 and 3A–3B, each of the cut pile hook assemblies 32 comprises a hook 50 that includes a shank 51 portion mounted within a holder or support 52 (FIG. 1) that carries the hook about a reciprocal motion indicated by arrows 53 and 53, into and out of engagement with a cut pile needle 17 as illustrated in FIGS. 1 and 2. The hooks 50 (FIGS. 1 and 3A–3B) each further include a body portion 54 that extends upwardly and away from the shank, and a tapered throat portion 56 that terminates in a hooked forward or distal end 57. The hooks each further include a pickup side 58 that generally is of an opposite hand to the take off or pickup of the cut pile needles 17. In similar fashion to the loopers 31, as the hooks are reciprocated in the direction of arrow 53, their hooked forward ends 57 pass between adjacent loop pile loopers 31 and engage the takeoff portion 19 of an associated cut pile needle 17 on the opposite side of the tufting zone 10, as the needles 17 are reciprocated to their lowered, engaging position, penetrating in the backing material. As the hooked front ends 57 of the hooks 50 engage takeoff portions 19 of their associated needles 17 and pick up and pull the yarns away from the cut pile needles 17, the needles are turned or reciprocated upwardly and the hooks 50 are moved in the direction of arrow 53. As a result, a series of loops of yarn 59 are formed along the throat portions 56 of the hooks 50.

As further illustrated in FIGS. 1–3A, each cut pile hook assembly 32 further includes a knife assembly 61 that is mounted adjacent the throat portion 56 of its associated hook 50. Each knife assembly 61 includes a cutting blade or knife 62 mounted in a holder 63 (FIG. 1) and having a cutting edge 64. Each of the cutting blades 62 are reciprocated about a cutting path along the throat portion 56 of its associated hook 50, so as to engage and sever the loops of yarn 59 formed along the throat portion of each cut pile hook in order to form the cut pile tufts 16 in the backing material 11.

Figure 4A:
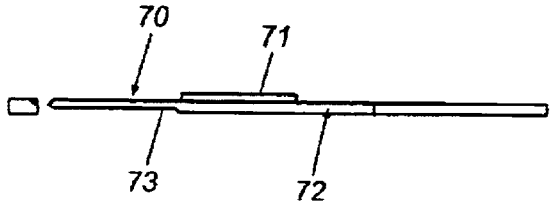
FIG. 4A is a plan view of a prior art configuration of a hook pile hook engaging a needle.
Figure 4B:
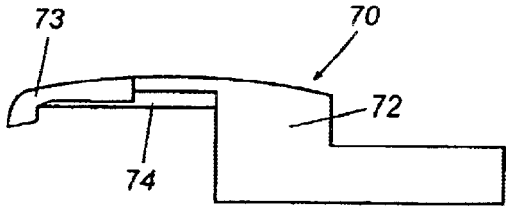
FIG. 4B is a side elevational view of a prior art cut pile hook.

Typically, in conventional tufting machines, the knife will be of the same "hand" cutting as the hook, i.e., a right hand cutting blade for a right hand takeoff hook, or a left hand cutting blade for a left hand takeoff hook, and generally will be positioned on the opposite side of the takeoff or pickup region of the looper. FIGS. 4A and 4B illustrate an example of such a prior art cut pile hook and knife assembly 70. As shown in FIG. 4A, in such prior art hook and knife assemblies, each of the knives 71 generally is mounted on an opposite side of its hook 72 from the needle to be engaged by the hook and opposite the pickup side 73 of the hook 72 so as to generally avoid interference of the knife with the needle to be engaged by the hook as the hook strikes the takeoff portion of the needle. In addition, as generally illustrated in FIG. 4B, conventional cut pile hooks 72 further typically will include a J-cut champfer region or zone, shown at dashed lines 74, typically formed on the pickup side 73 of the hook. The purpose of the J-cut champfer is to help equalize the amount of yarn on each side of the throat of the looper so that when the loops of yarns contained on the throat of each hook as severed by the knife, the loops are cut evenly, as opposed to one side of the loop being longer than the other.

By contrast, as illustrated in FIGS. 3A and 3B, with the cut pile hook assembly 32 of the present invention, the knives 62 are of an opposite hand cutting to the pickup of their associated hooks 50; for example, if the hook is a left hand pickup hook, a right hand cutting blade or knife is used, and conversely, for a hook having a right hand pickup hook, a left hand cutting knife will be used. The knives 62 further are mounted along the pickup side of their hooks as indicated in FIGS. 2 and 3A. As a result, the knives are further aligned with, and thus are on the same side of the hooks as their respective cut pile needles as the needles are engaged by their associated hooks, instead of the needles being positioned on the opposite side of the hooks from the knives as in conventional tufting machines (as shown in FIG. 4B). In addition, a J-cut champfer 76 (FIG. 3B) will be formed on the opposite side of the hook 50 from its pickup side 58.

As the loopers and hook assemblies 31 and 32 (FIG. 1) are reciprocated in the direction of arrows 47 and 53, respectively, and the loop pile and cut pile needles penetrate the backing material, the bills and throats of the loopers and cut pile hooks will pass adjacent each other without obstruction and will engage their associated loop pile and cut pile needles 18 and 17 to pickup and to form loops of yarn on the throat portion of each of the looper and cut pile hooks. Thereafter, as the knives of each of the cut pile hook assemblies are reciprocated about their cutting path, they will engage and sever the loops of yarns contained on the throats of each of the cut pile hooks to form the cut pile tufts 16. At the same time, the loops of yarn held on the bills of the loop pile loopers are simply pulled off the loopers as the backing material is moved along its path of travel 12, leaving the loop pile tufts 14 of yarn in the backing material 11, as shown in FIG. 1. Thus, the backing fabric will have cut pile and loop pile tufts of yarn formed therein.

Figure 5:
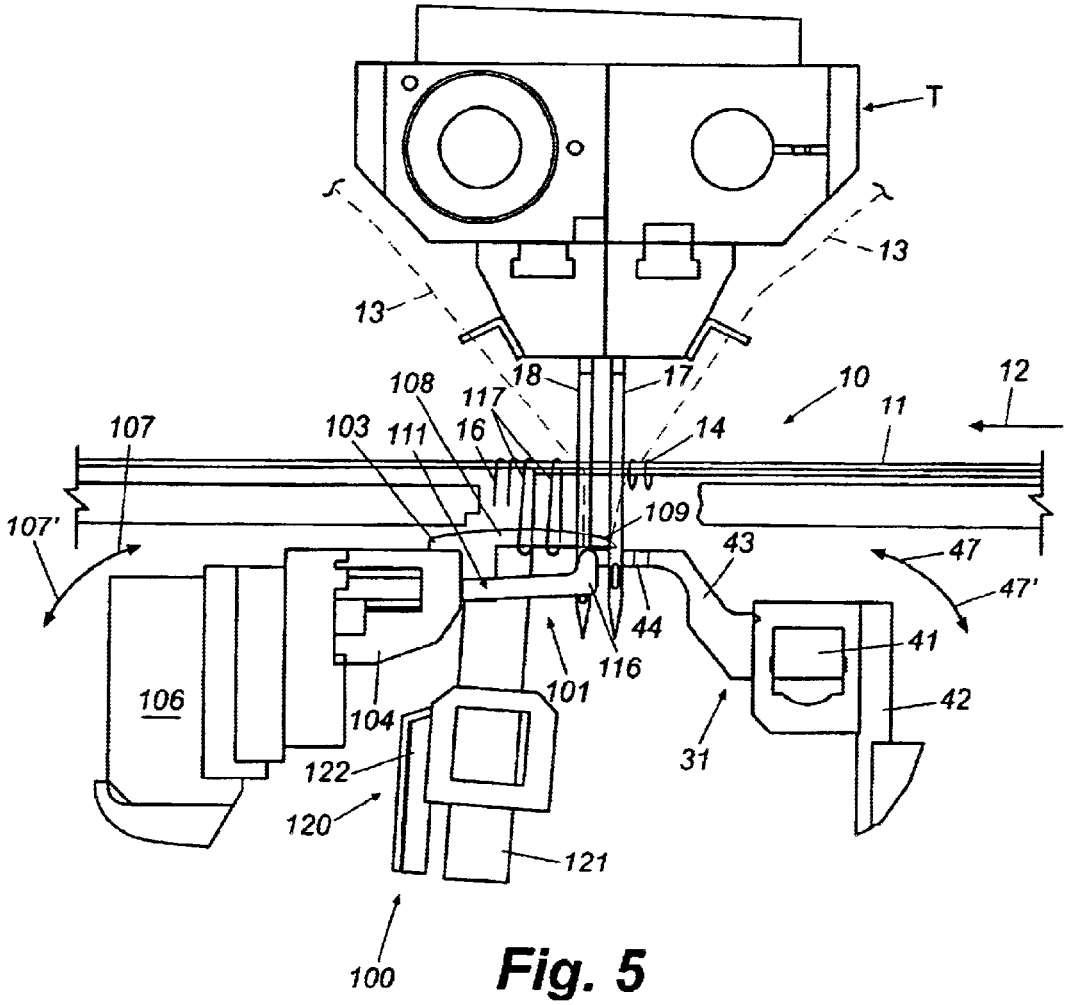
FIG. 5 is a side elevational view illustrating a second embodiment of the present invention in a tufting machine utilizing cut/loop loopers or hooks.
Figure 6:
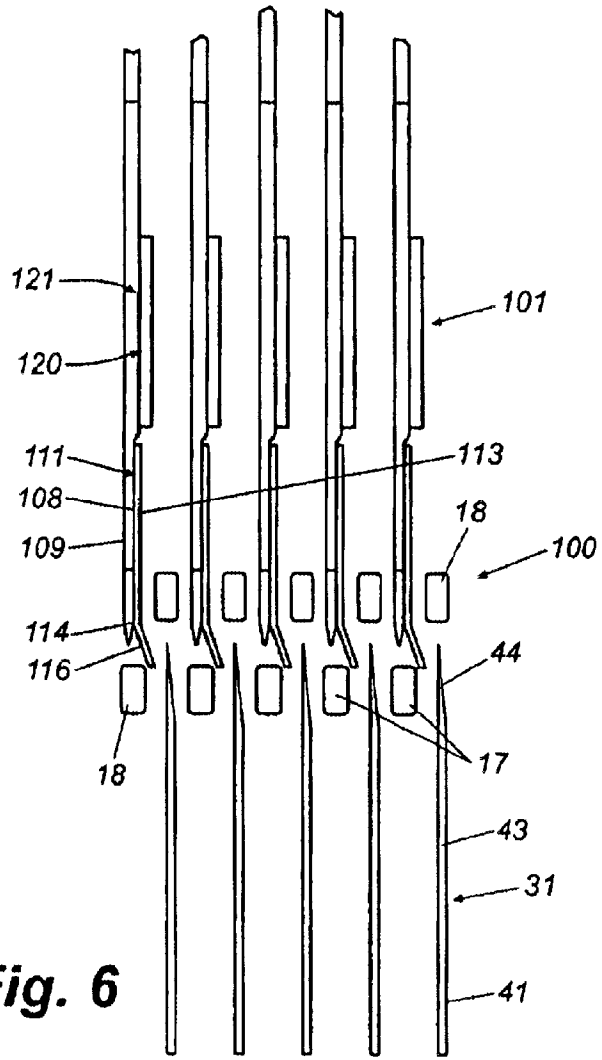
FIG. 6 is a schematic illustration showing the movement of the loopers and cut/loop loopers or hooks between one another into engagement the opposed rows of needles according to the embodiment of the present invention as shown in FIG. 5.

FIGS. 5–6 illustrate an additional embodiment of the method and apparatus for forming cut and loop pile tufts of the present invention for use with a cut/loop looper assembly 100 for a tufting machine. In this embodiment, as with the embodiment of the present invention illustrated in FIGS. 1–2, the tufting machine T (FIG. 5) generally includes two spaced rows of needles 17 and 18, although only one needle 17, 18 of each row is shown for clarity. The needles 17/18 carry yarns 13 for insertion into a backing material 11, which will be engaged by the cut/loop looper assembly 100 of the tufting machine to form loop pile tufts 14 and cut pile tufts 16 in the backing material. As further shown in FIG. 5, the cut/loop looper assembly 100 generally is positioned below the tufting zone 10 of the tufting machine and over which packing material 11 is moved in the direction of arrow 12 and includes a series of loop pile loopers 31 positioned along the upstream side of the tufting zone, as well as a series of cut/loop loopers or hooks 101 positioned along the downstream side of the tufting machine opposite the loop pile loopers 31.

As with the loop pile loopers 31 illustrated in FIG. 1, each loop pile looper 31 of the cut/loop looper assembly 100 shown in FIG. 5 generally includes a shank portion 41 that is mounted in a holder or block 42 and forward the extending body portion 43 that terminates in a tapered bill portion or forward end 44. As further indicated in FIG. 6, the loop pile loopers 31 are spaced from each other so as to define gaps 33 therebetween, while the cut/loop loopers or hooks 101 are spaced transversely so as define gaps 102 therebetween. The loop pile loopers 31 are aligned with the gaps 102 between each of the cut/looper or hooks, while the cut/loop loopers or hooks are each aligned with a gap 33 formed between each of the loop pile loopers 31. In addition, the cut pile needle 17 positioned along the upstream side of the tufting zone will pass through the gap 33 between the loop pile loopers 31 for engagement therewith by the cut/loop loopers or hooks, while the loop pile needles 18, positioned along the downstream side of the tufting zone, will pass through the gaps 102 between each of the cut/loop loopers or hooks for engagement by the bill portions 44 of the loop pile loopers 41 as the loop pile loopers are rocked forwardly in the direction of arrow 47 during a stroke or cycle of the tufting machine.

Figure 7A:
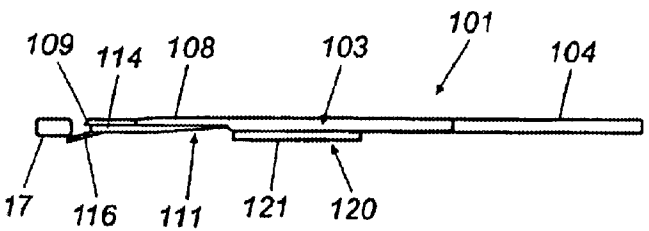
FIG. 7A is a top plan view illustrating the configuration of a cut/loop looper according to the embodiment of the invention illustrated in FIG. 5.
Figure 7B:
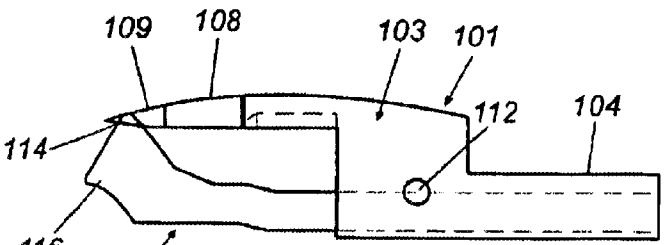
FIG. 7B is a side elevational view illustrating a cut/loop looper or hook for use in the embodiment of the present invention illustrated in FIG. 5.

As generally illustrated in FIGS. 5 and 7A–7B, each cut/loop looper or hook 101 generally includes a body 103 with a rear or shank portion 104 mounted within a holder 106 (FIG. 5) that carries the cut/loop looper or hook about a reciprocal motion indicated by arrows 107 and 107 into and out of engagement with a cut pile needle 17 as illustrated in FIG. 5, and further includes a bill or forward portion 108 that terminates in a pointed or tapered front end or forward end 109. As further shown in FIGS. 5 and 7B, a clip 111 is attached to the shank portion 104 of each cut/loop looper or hook 101. Each clip 111 typically is formed from a metal material such as a spring steel or other similar, resilient material that can be attached to its looper body 103 by a fastener 112 (FIG. 7B) such as a rivet, bolt, welding or other similar fastening mechanisms as will be understood in the art. The clip includes a forwardly extending front body section 113 having an engaging portion 114 that bears against the forward end 109 of its attached cut/loop looper or hook 101 as indicated in FIGS. 6, 7A, and 7B, and terminates in a front or proximal end 116. The forward end 116 is angled slightly outwardly as is shown in FIG. 6, such that as the forward end 109 of each cut/loop looper or hook strikes its respective cut pile needle 17, the clip can be urged away from the bill portion of the cut/loop looper or hook to allow the passage of the needle therebetween as the yarn is picked up or taken off its needle 17 to form a loop of yarn 117 along the bill 108 of the cut/loop looper or hook. As the cut pile needles 17 are retracted from engagement with their cut/loop loopers or hooks, the clips will be returned to their tight bearing engagement with the forward end or bill portions of their respective cut/loop loopers or hooks so as to retain the loops of yarn 117 formed therealong.

As further illustrated in FIG. 5, a knife assembly 120 is provided with each of the cut/loop loopers or hooks 101. Each knife assembly 120 will include a cutting blade or knife 121 mounted in a holder 122 so as to be reciprocated about a cutting path along the bill portion of its associated cut/loop looper or hook as to engage and sever the loops of yarn 117 formed along the bill portion of each cut/loop looper or hook to form the cut pile tufts 16 in the backing material 11. As discussed above with respect to the embodiment of FIG. 1, the knives 121 of this embodiment of the present invention will be of an opposite hand cut to the pickup of its associated cut/loop looper. For example, if the cut/loop looper is formed with a left hand pickup a right hand cutting blade or knife will be used, and conversely, for a cut/loop looper having a right hand pickup, a left hand cutting knife will be used. As further illustrated in FIGS. 5 and 6, the knife assemblies 120 further will be mounted along the pickup side of their respective cut/loop loopers and thus are aligned with and/or on the same side of their respective cut/loop loopers as the cut pile needles 17 being engaged thereby instead of being positioned on the opposite side of the cut/loop loopers as are the knives in most conventional tufting machines such as illustrated in FIG. 4B.

As shown in FIG. 5, as the loopers 31 and cut/loop loopers 101 are reciprocated in the direction of arrows 47 and 107, respectively, the loop pile and cut pile needles 18/17 will penetrate the backing material 11 while the bills of the loopers 31 and cut/loop loopers 101 pass adjacent each other without obstruction, so as to engage their associated loop pile and cut pile needles to pickup and form loops of yarn along the bill portion of each of the loopers and cut/loop loopers without interference. The clips 111 of the cut/loop loopers further will retain the loops 117 formed thereon during the continued reciprocal motion of the cut/loop loopers until the knives associated with each of the cut/loop loopers are reciprocated about their cutting path into engagement to sever the loops of yarns contained on the bill portions of each of the cut/loop loopers. At the same time, the loops of yarn held on the bills of the loop pile loopers are simply pulled off their loopers as the backing material is moved along its path of travel 12 leaving the loop pile tufts 14 and cut pile tufts 16 formed in the backing material.

The present invention thus enables the passing of the loopers and hooks through the gaps defined therebetween with the incidents of previously sewn loops of yarn being engaged by the cut pile hooks during the production of finer or smaller gauge (i.e., 5/32–1/16 gauge) carpets being minimized, while still further enabling the stagger between the rows of needles to be reduced to as short as approximately ½ inch–approximately ¼ inch or less without the knives engaging the previously sewn loops or otherwise engaging and interfering with the operation of the loopers. As a result, given the reduction in the stagger, the problems of side matching, i.e., matching of the left and right seam of a carpet, are minimized since the stagger can be reduced, which correspondingly reduces the stretching and/or necking of the backing material as the backing material passes passing through the tufting zone.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A tufting machine for forming spaced rows of loop pile tufts and cut pile tufts in a base fabric passing through a tufting zone of the tufting machine, comprising:

a first row of needles positioned adjacent an upstream side of the tufting zone, each needle having a pickup area formed therealong and carrying a yarn for introduction into the base fabric;

a second row of needles spaced transversely across the tufting zone from said first row of needles, said second row of needles each having a pickup area and carrying yarns for introduction into a base fabric;

a series of hooks moveable between said needles of said second row of needles into engagement with said needles of said first row of needles to pickup the yarns therefrom;

a series of knives each positioned along a pickup side of one of said hooks and adapted to engage the yarns picked up by the hooks for forming the cut pile tufts in the base fabric;

a series of loopers moveable between said needles of said first row of needles into engagement with said needles of said second row of needles so as to engage and pickup the yarns therefrom to form the loop pile tufts in the base fabric.

2. The tufting machine of claim 1 and wherein said knives are of an opposite hand cutting to the pickup of said hooks.

3. The tufting machine of claim 2 and wherein said knives are right hand cut and said hooks are left hand pickup.

4. The tufting machine of claim 2 and wherein said knives are left hand cut and said hooks are right hand pickup.

5. The tufting machine of claim 2 and wherein said knives are generally aligned with said needles of said first row of needles.

6. The tufting machine of claim 1 and wherein said hooks further include a champfer formed along an opposite side of each of said hooks from each knife associated with said hooks.

7. The tufting machine of claim 1 and wherein said needles of said first and second rows of needles are spaced approximately ¼ inch apart.

8. A method of forming spaced rows of cut pile and loop pile tufts in a base fabric, comprising:

moving a base fabric along a path of travel through a tufting zone;

engaging the base fabric with a first row of spaced needles carrying a plurality of yarns through the base fabric;

engaging the base fabric with a second row of spaced needles, transversely spaced from the first row of needles across the tufting zone and carrying a second plurality of yarns through the base fabric;

moving a plurality of hooks having a pickup across the tufting zone between the needles of the second row of needles and into engagement with the yarns carried by the needles of the first row of needles;

providing a series of knives of an opposite hand cutting to the pickup of each of the hooks, each positioned along a pickup side of one of the hooks and reciprocating the knives into engagement with the yarns to form the cut pile tufts in the base fabric; and moving a series of loopers across the tufting zone between the needles of the first row of needles and into engagement with the yarns carried by the needles of the second row of needles to form the loop pile tufts in the base fabric.

9. The method of claim 8 and wherein providing the knives along the pickup side of each hook comprises aligning each knife with one of the needles of the needle of the first row of needles.

10. The method of claim 8 and further comprising cutting a series of yarns engaged on the hooks with the knives to form the cut pile tufts.

11. The method of claim 8 and further comprising staggering the first and second rows of needles up to approximately ½ inch apart.

12. A tufting machine for forming spaced rows of loop pile and cut pile tufts of yarn in a backing, comprising:

a first row of needles;

a second row of needles spaced longitudinally from said first row of needles;

a looper assembly positioned below said first and second rows of needles and including:

a first row of loopers positioned below said first row of needles, said loopers each having a desired hand pickup and being transversely spaced so as to define a series of gaps therebetween, through which said first row of needles is passed, said first row of loopers being moveable into engagement with said second row of needles to engage and pickup yarns therefrom to form the loop pile tufts;

a second row of loopers opposite said first row of loopers, positioned below said second row of needles and each having a desired hand pickup and being transversely spaced to define gaps through which said second row of needles are passed, said second row of loopers being moveable into engagement with said first row of needles to engage and pickup loops of yarns therefrom for forming the cut pile tufts; and a series of knives positioned along a pickup side of each of said loopers of said second row of loopers, said knives being of an opposite hand cutting to said pickup of said loopers of said second row of loopers and moveable in a cutting motion to sever the loops of yarns along said loopers of said second row of loopers to form the cut pile tufts;

whereby said first and second rows of loopers are passed by each other and into engagement with said second and first rows of needles, respectively.

13. The tufting machine of claim 12 and wherein said loopers of said second row of loopers comprise cut/loop loopers each having a looper clip for engaging and holding the loops of yarn thereon for cutting by the knives.

14. The tufting machine of claim 12 and wherein said knives are right hand cut and said hooks are left hand pickup.

15. The tufting machine of claim 13 and wherein said knives are left hand cut and said hooks are right hand pickup.

16. The tufting machine of claim 12 and wherein each of said loopers of said first and second rows of loopers comprises a looper body having a shank portion and a forwardly extending bill portion.

17. The tufting machine of claim 16 and wherein said loopers of said second row of loopers each further comprise cut/loop loopers each including a clip adapted to engage said bill portion of said loopers of said second row of loopers to retain the loops of yarn formed thereon for cutting by said knives.

* * * * *